US009301580B1

(12) United States Patent
Rafaelian

(10) Patent No.: US 9,301,580 B1
(45) Date of Patent: Apr. 5, 2016

(54) SLIDING ELEMENT FOR ADJUSTABLE JEWELRY

(71) Applicant: Alex & Ani, LLC, Cranston, RI (US)

(72) Inventor: Carolyn A. Rafaelian, Cranston, RI (US)

(73) Assignee: Alex and Ani, LLC, Cranston, RI (US)

( * ) Notice: Subject to any disclaimer, the term of this patent is extended or adjusted under 35 U.S.C. 154(b) by 0 days.

(21) Appl. No.: 14/568,326

(22) Filed: Dec. 12, 2014

(51) Int. Cl.
*A44C 5/22* (2006.01)
*A44C 5/00* (2006.01)
*B21D 13/10* (2006.01)

(52) U.S. Cl.
CPC ..... *A44C 5/22* (2013.01); *A44C 5/0069* (2013.01); *B21D 13/10* (2013.01); *Y10T 24/3987* (2015.01)

(58) Field of Classification Search
CPC ..... A44C 5/22; A44C 5/069; A44C 5/0076; A44C 5/00; A44C 5/0053; A44C 5/0061; A44C 5/185; F16G 11/14; Y10T 24/3987
USPC ..... 63/3.2, 11; 24/66.9, 66.1, 115 H, 115 R, 24/116 A, 116 R, 129 B, 129 W, 115 A
See application file for complete search history.

(56) References Cited

U.S. PATENT DOCUMENTS

| | | | | |
|---|---|---|---|---|
| 434,220 | A * | 8/1890 | Whitney | 63/11 |
| 895,078 | A * | 8/1908 | Doppenschmitt | A44C 17/0208 63/11 |
| 993,303 | A | 7/1910 | Kirby | |
| 1,689,251 | A * | 10/1928 | Ogush | 24/115 R |
| 2,484,200 | A * | 10/1949 | Werntz | A44C 5/14 224/166 |
| 2,637,884 | A * | 5/1953 | Morehouse | 24/336 |
| 3,675,277 | A * | 7/1972 | Day | 24/66.9 |
| 4,499,634 | A * | 2/1985 | Zimmardi | 24/116 A |
| D703,088 | S | 4/2014 | Fiasconaro | |
| 2006/0000116 | A1* | 1/2006 | Brewer | 36/50.1 |
| 2011/0314866 | A1* | 12/2011 | Niikura | 63/3.2 |
| 2014/0090215 | A1 | 4/2014 | Lixenberg | |

OTHER PUBLICATIONS http://www.rings-things.com/blog/2011/06/#.VDRi6fldUWY.
http://www.icecarats.com/Sterling-Silver-Black-Leather-Expandable-Cord-Bracelet-312709.aspx.

* cited by examiner

*Primary Examiner* — Abigail Morrell
(74) *Attorney, Agent, or Firm* — Wolf, Greenfield & Sacks, P.C.

(57) ABSTRACT

Disclosed is a sliding element for use with jewelry including a plate body, a sliding flange extending from a first lateral edge of the plate body, and a crimping flange extending from a second lateral edge of the plate body. The plate body, the sliding flange, and the crimping flange can be stamped from a uniform flat metal sheet.

9 Claims, 1 Drawing Sheet

SLIDING ELEMENT FOR ADJUSTABLE JEWELRY

BACKGROUND OF THE INVENTION

1. Field of the Invention

The invention generally relates to jewelry and more particularly to slider elements for jewelry.

2. Background of the Related Art

Sliding elements (e.g., beads) have been used to create adjustable jewelry such as bracelets and necklaces. Traditionally, the sliding element includes a cast or formed shape. The ends of a band can be affixed to a portion of the sliding element using adhesives, welding, or the like while other portions of the band can pass through a sliding portion of sliding element to allow adjustment of the size of the bands. For example, see U.S. Design Pat. No. D703,088 which discloses an adjustable bracelet.

Conventional sliding elements can be complicated to manufacture and install on bands and also do not provide suitable surface area for indicia to be applied thereto. Improved sliding elements for jewelry bands that reduce manufacturing cost and require simplified installation onto bands are needed. This disclosure provides a solution for this need.

SUMMARY OF THE INVENTION

The purpose and advantages of the invention will be set forth in and apparent from the description that follows. Additional advantages of the invention will be realized and attained by the devices, systems and methods particularly pointed out in the written description and claims hereof, as well as from the appended drawings.

To achieve these and other advantages and in accordance with the purpose of the invention, as embodied, in one aspect, a sliding element for use with jewelry includes a plate body, a sliding flange extending from a first lateral edge of the plate body, and a crimping flange extending from a second lateral edge of the plate body.

The plate body, the sliding flange, and the crimping flange can be stamped from a uniform flat metal sheet. The sliding flange and the crimping flange can be curled under the plate body. In certain embodiments, the sliding flange and crimping flange can have different lengths.

The sliding flange can define an axially extending sliding channel sized to allow a portion of a band to slide axially therethrough. The crimping flange can define an axially extending crimping channel sized to be smaller than the sliding channel size such that the crimping flange can forcibly engage a portion of a band.

In certain embodiments, the sliding flange can be shaped to define a plurality of sliding channels and the crimping flange can be shaped to define a plurality of crimping channels.

The sliding flange can include a coating disposed on a surface thereof. The coating can include teflon or any other suitable coating for reducing the sliding resistance of the band.

The plate body can be flat or have any other suitable shape. The plate body can include indicia disposed on an outer surface thereof.

An adjustable article of jewelry can include a band having first and second ends, a first sliding element including as described herein and a second sliding element. The first end of the band is crimped within the crimping flange such that the first end is connected to the first sliding element and the band is slidable through the first sliding flange.

The second sliding element can also be a sliding element as described herein wherein the band is crimped within the second crimping flange such that second end is connected to the second sliding element and the band is slidable through the second sliding flange. The second sliding element can be any other suitable sliding element.

The band can be made of flexible material. For example, the band can be made of an elastic cord material. In certain embodiments, the band is metal and/or chain.

A method for manufacturing a sliding element includes stamping an article of plate metal into predetermined shape including at least a first lateral edge and a second lateral edge, bending the first lateral edge to form a sliding flange, and bending the second lateral edge to for a crimping flange.

The method can further include disposing indicia on an outer surface of the plate metal. The method can further include forming the sliding flange or crimping flange to include a plurality of sliding channels or crimping channels, respectively. The method can further include crimping the crimping flange around a band.

BRIEF DESCRIPTION OF THE DRAWINGS

So that those having ordinary skill in the art to which the present invention pertains will more readily understand how to employ the systems and methods of the present invention, embodiments thereof will be described in detail hereinbelow with reference to the drawings, wherein.

These and other aspects of the subject disclosure will become more readily apparent to those having ordinary skill in the art from the following detailed description of the invention taken in conjunction with the drawings.

DETAILED DESCRIPTION OF CERTAIN EMBODIMENTS

Embodiments of this disclosure are now described more fully with reference to the accompanying drawings, in which an illustrated embodiment is shown. This disclosure is not limited in any way to the illustrated embodiment as the illustrated embodiment described below is merely an example which can be embodied in various forms, as appreciated by one skilled in the art. Therefore, it is to be understood that any structural and functional details disclosed herein are not to be interpreted as limiting, but merely as a basis for the claims and as a representative for teaching one skilled in the art to variously employ the embodiments disclosed herein. Furthermore, the terms and phrases used herein are not intended to be limiting but rather to provide an understandable description of the embodiments herein.

Figure 1:
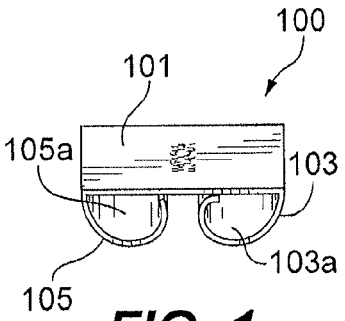
FIG. 1 illustrates a perspective view of an embodiment of the present invention.
Figure 2:
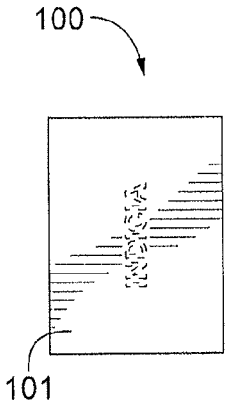
FIG. 2 illustrates a top view of the sliding element of FIG. 1.
Figure 3:
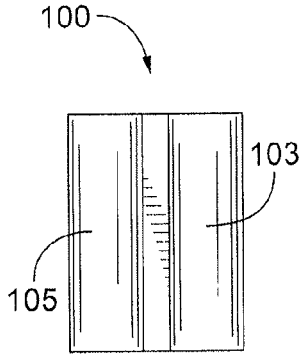
FIG. 3 illustrates a bottom view of the sliding element of FIG. 1.

The present disclosure generally relates to articles of jewelry and sliding elements therefor. Turning now descriptively to the drawings, in which similar reference numerals denote similar elements throughout the several views, FIG. 1 depicts an embodiment of a sliding element 100 that has been constructed in accordance with this disclosure. The sliding element 100 includes a plate body 101 including any suitable material (e.g., metal, composite) which is capable of being formed into the desired slide configuration.

A sliding flange 105 extends from a first lateral side of the plate body 101 and defines a sliding channel 103*a* having a sliding channel size (e.g., diameter, width, length, and/or any other suitable dimension) that is configured to allow a portion of a band (e.g., band 400 of FIG. 4) to slide therethrough.

A crimping flange 103 extends from a second lateral side of the plate body 101 underneath the plate body 101. The crimping flange 103 defines a crimping channel 103*a*. The crimping flange 103 can be disposed over a band and crimped such that the crimping channel 103*a* includes a crimping channel size (e.g., diameter, width, length, and/or any other suitable dimension) that is smaller than the sliding channel size. In this manner, the crimping flange 103 can forcibly engage the band to prevent it from moving relative thereto, thereby affixing the sliding element 100 to the band.

In certain embodiments, the plate body 101, the sliding flange 105, and the crimping flange 103 can be stamped from a flat metal sheet. The crimping flange 103 and sliding flange 105 can be bent during the stamping process using a suitable stamping die. In some cases, each flange can be bent after stamping in a separate bending step. Any other suitable method of forming the sliding element 100 is contemplated herein.

The sliding flange 105 and crimping flange 103 can have the same or different lengths and can include any suitable shape. The sliding flange 105 and/or the crimping flange 103 can be curled under the plate body 101 as shown in FIG. 1. However, those skilled in the art would readily appreciate that the sliding flange 105 and the crimping flange 103 can be curled on opposite sides of the plate body 101 as shown (e.g., a flange curled over the top and a flange curled under bottom).

Figure 5:
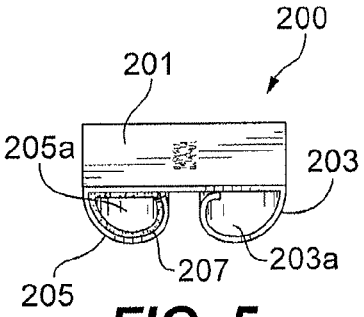
FIG. 5 illustrates a perspective view of an embodiment of a sliding element in accordance with this disclosure, showing a coating disposed on the surface of the sliding flange.

Referring to FIG. 5, in certain embodiments, a sliding element 200 can include a plate body 201, a crimping flange 203 defining a crimping channel 203*a*, and a sliding flange 205 defining a sliding channel 205*a* that function similar to those described above. As shown, the sliding flange 205 can include a coating 207 disposed on a surface thereof (e.g., within the sliding channel 205*a*). The coating 207 can include teflon or any other suitable coating for reducing the sliding resistance of a band (e.g., a chain band) when sliding therethrough.

Figure 6:
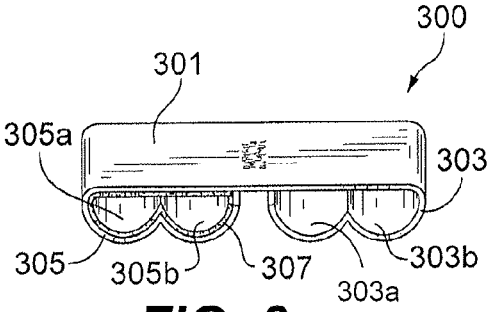
FIG. 6 illustrates a perspective view of an embodiment of a sliding element in accordance with this disclosure having multiple channels defined by each flange.

Referring to FIG. 6, in certain embodiments, a sliding element 300 can include a plate body 301, a crimping flange 303, and a sliding flange 305 that function similar to those described above. However, as shown, the sliding flange 305 can be shaped to define a plurality of sliding channels and/or the crimping flange 303 can be shaped to define a plurality of crimping channels 303*a*, 303*b*. One or more of the sliding channels 305*a*, 305*b* can include a coating 307 similar to a coating 207 as described above.

Figure 4:
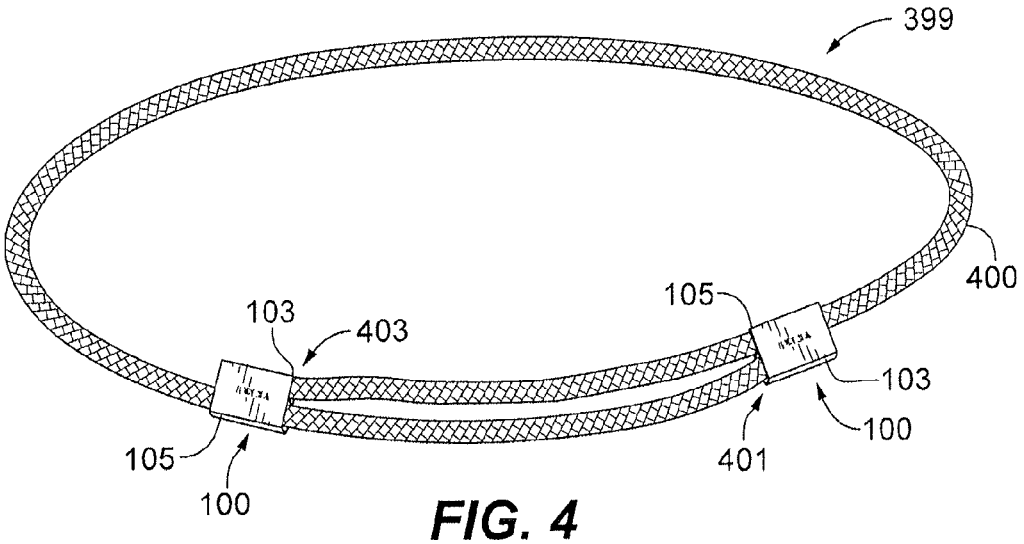
FIG. 4 illustrates a perspective view of an article of jewelry utilizing two of the sliding elements of FIG. 1.

Referring to FIG. 4, there is shown an adjustable article of jewelry identified by reference numeral 399. The adjustable article of jewelry 399 includes a band 400 that has first end 401 and second end 403, at least two sliding elements 100 as described above. It is contemplated that only one sliding element 100 as described above can be disposed whereas the second sliding element is any other suitable sliding element.

The first end 401 of the band 400 is crimped within the channel 103*a* formed by crimping flange 103 of a first sliding element 100 such that the first end 401 is affixed to the first sliding element 100. The band 400 is disposed in a second sliding flange 105 of a second sliding element 100 and in sliding the sliding flange 105 of the first sliding element 100. The second end 403 of the band 400 is crimped within the second crimping flange 103 such that second end 403 is affixed to the second sliding element. This arrangement allows for an adjustable size article of jewelry 399 (e.g., a bracelet, a necklace).

The band 400 can be made of flexible material. In certain embodiments, the band 400 is made of an elastic cord material. In other embodiments, the band 400 is metal (e.g., metal wire, chain). Any suitable material for allowing the sliding element 100 to crimp or otherwise forcibly fit thereto is contemplated herein.

In accordance with another aspect of this disclosure, a method for manufacturing a sliding element 100 includes stamping an article of plate metal into predetermined shape including at least a first lateral edge and a second lateral edge. The method also includes bending the first lateral edge to form a sliding flange 105 as described above and bending the second lateral edge to for a crimping flange 103 as described above. Bending can be accomplished during or after the stamping of the article of plate metal in any suitable manner.

The method can further include disposing indicia on an outer surface of the plate metal. The method can further include forming the sliding flange 105 or crimping flange 103 to include a plurality of sliding channels or crimping channels, respectively. The method can further include crimping the crimping flange 105 around a band 400.

The method can further include disposing a coating 207 as described above on a surface of the sliding flange 105. This can be done at any suitable portion of the method. For example, the coating 207 can be applied to a portion of the plate metal that will be bent into the sliding flange 105 before bending. In other cases, the coating 207 can be applied after the sliding flange 105 is formed.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges may independently be included in the smaller ranges is also encompassed within the invention, subject to any specifically excluded limit in the stated range. Where the stated range includes one or both of the limits, ranges excluding either both of those included limits are also included in this disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the disclosed embodiments, exemplary methods and materials are now described. All publications mentioned herein are incorporated herein by reference to disclose and describe the methods and/or materials in connection with which the publications are cited.

It must be noted that as used herein and in the appended claims, the singular forms "a", "an," and "the" include plural referents unless the context clearly dictates otherwise. Thus, for example, reference to "a stimulus" includes a plurality of such stimuli and reference to "the signal" includes reference to one or more signals and equivalents thereof known to those skilled in the art, and so forth.

The descriptions above and the accompanying drawings should be interpreted in the illustrative and not the limited sense. While the invention has been disclosed in connection with the embodiments disclosed herein, it should be understood that there may be other embodiments which fall within the scope of this disclosure and the following claims. Where a claim, if any, is expressed as a means or step for performing a specified function, it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. An article of jewelry, comprising:

a) a band formed of a single strand of elastic cord having a first end and a second end;

b) a first sliding element including:

i) a plate body;

ii) a sliding flange extending from a first lateral edge of the plate body and curled under the plate body to form a first channel; and iii) a crimping flange extending from a second lateral edge of the plate body and curled under the plate body to form a second channel, wherein each of the first channel and the second channel has an axial dimension and a transverse dimension wherein the transverse dimension of the second channel is smaller than the transverse dimension of the first channel;

wherein the crimping flange forcibly engages a portion of the band within the crimping flange such that the portion of the band is fixedly connected to the first sliding element, wherein another portion of the band is located within and slidable through the sliding flange; and c) a second sliding element operatively disposed on the band.

2. The article of jewelry of claim 1, wherein each of the first sliding element and the second sliding element are stamped from a flat metal sheet.

3. The article of jewelry of claim 1, wherein the sliding flange and the crimping flange have different lengths.

4. The article of jewelry of claim 1, wherein the sliding flange includes a coating disposed on a surface thereof.

5. The article of jewelry of claim 1, wherein the plate body includes indicia disposed on an outer surface thereof.

6. The article of jewelry of claim 1, wherein the second sliding element includes:

i) a second plate body;

ii) a second sliding flange extending from a first lateral edge of the second plate body and curled under the second plate body to form a first channel of the second sliding flange; and iii) a second crimping flange extending from a second lateral edge of the second plate body and curled under the second plate body to form a second channel of the second sliding flange wherein each of the first channel and the second channel of the second sliding flange has an axial dimension and a transverse dimension wherein the transverse dimension of the second channel of the second sliding flange is smaller than the transverse dimension of the first channel of the second sliding flange; and wherein the second crimping flange forcibly engages a second portion of the band within the second crimping flange such that the second portion of the band is fixedly connected to the second sliding element, wherein a further portion of the band is slidable through the second sliding flange.

7. The article of jewelry of claim 6, wherein the band is metal.

8. The article of jewelry of claim 6, wherein the second portion of the band includes the second end.

9. The article of jewelry of claim 1, wherein the portion of the band includes the first end.

* * * * *